United States Patent [19]

Menser

[11] Patent Number: 4,588,616

[45] Date of Patent: May 13, 1986

[54] METHOD AND APPARATUS FOR PRESSURE SATURATION OF SUBSTRATE

[75] Inventor: Howard K. Menser, Plymouth, Ind.

[73] Assignee: Miply Equipment Inc., South Bend, Ind.

[21] Appl. No.: 661,913

[22] Filed: Oct. 17, 1984

Related U.S. Application Data

[63] Continuation-in-part of Ser. No. 641,568, Aug. 16, 1984, abandoned.

[51] Int. Cl.[4] ..... B05D 1/18; B05C 3/12

[52] U.S. Cl. ..... 427/430.1; 118/117; 118/419; 118/429; 427/439

[58] Field of Search ..... 68/15, 158; 118/117, 118/419, 429; 156/189; 427/365, 439, 430.1

[56] References Cited

U.S. PATENT DOCUMENTS

| | | | |
|---|---|---|---|
| 2,176,835 | 10/1939 | Cumfer . | |
| 2,711,032 | 6/1952 | Penley | 34/122 |
| 2,721,144 | 10/1955 | Penley | 118/419 X |
| 3,416,939 | 12/1968 | Schutt et al. | 106/84 |
| 3,449,156 | 6/1969 | Brown . | |
| 3,454,419 | 7/1969 | Smith et al. | 117/76 |
| 3,564,631 | 2/1971 | Burling . | |
| 3,616,194 | 10/1971 | Russell | 156/189 X |
| 3,616,660 | 11/1971 | Ingermarsson . | |
| 3,826,703 | 7/1974 | Russell | 156/189 |
| 4,152,908 | 5/1979 | Bertoldi | 68/158 |
| 4,411,216 | 10/1983 | Menser | 118/117 |

*Primary Examiner*—Michael R. Lusignan

*Attorney, Agent, or Firm*—Willian Brinks Olds Hofer Gilson & Lione

[57] ABSTRACT

A pressure saturator for impregnating a substrate with a saturant is disclosed, having a block member with an arcuate, sloping upper surface that is graduated from a relatively deep portion to a relatively shallow portion. Rollers are disposed on each side of the block member for conveying the substrate into and out of the saturator, and a mandrel is disposed between the rollers for guiding the substrate through the saturator. The lower portion of the mandrel is spaced from the block member and extends into the recess formed by the arcuate surface to define a chamber therebetween. The chamber has an inlet and an outlet for admitting the substrate and the saturant, and converges in depth from the inlet region to the outlet region to pressurize the solution and force the saturant into the interstices of the substrate.

48 Claims, 5 Drawing Figures

METHOD AND APPARATUS FOR PRESSURE SATURATION OF SUBSTRATE

BACKGROUND OF THE INVENTION

This application is a continuation-in-part of co-pending application Ser. No. 641,568, filed Aug. 16, 1984, now abandoned.

A porous substrate material, such as paper, can be impregnated with one or more of various solids in a saturant solution to form a product which has greatly increased utility compared to untreated substrate. For example, a substrate, such as Kraft paper, can be impregnated with an alkali metal silicate in solution to form a product which exhibits strength, water and fire resistance, and rigidity far superior to that of the untreated paper. Such a product can be used to produce superior packaging or wrapping material, or several layers of the product may be laminated into counter tops, wall paneling, and other construction materials. Substrate impregnated with melamine resin, for example, which is a thermosetting resin, can be used to produce construction materials which are similar in form and properties to the product sold under the trademark "Formica". The use of inexpensive precursors, such as paper and the chemical additives to form such products, provides a significant cost advantage over the use of more expensive materials, such as plastic, wood, or metal. The advantages gained from the relative accessibility and low expense of the raw materials are diminished only by the relative inefficiency and expense of the impregnation apparatus and processes that have previously been available.

The process itself involves subjecting a substrate to a normally heated and pressurized saturant solution to coat the fibers of the substrate with the solids in the saturant, and/or to replace the air contained in the interstices of the substrate with the saturant material. With the solids in place, the carrier, which may be water or another appropriate medium, for example, acetone, then evaporates, leaving the fibers encapsulated by the solid material. Many interrelated factors combine to influence the end product. For the substrate, the composition and thickness of the material are important. For the saturant solution, the composition, temperature, viscosity, and relative pressure are important. For the process itself, the design of the saturating apparatus and the speed at which the process is carried out are important.

My U.S. Pat. No. 4,411,216 for a Pressure Saturator discloses a saturating apparatus which can achieve a near 100% weight-to-weight ratio of saturant to substrate in a single rapid transfer through the apparatus. The process involves heating a minimal amount of the saturant solution, which may or may not be pressurized. With concentrations approaching 100%, the end product exhibits substantial rigidity and most of the desirable characteristics of the additive or additives from the saturant solution. However, a need presently exists for an improved saturator which can operate with improved speed and reliability of operation.

SUMMARY OF THE INVENTION

It is, therefore, one of the principal objects of the present invention to provide a pressure saturator which can impregnate a saturant material into a substrate in a wide range of the concentration ratio of the weight of the saturant to the weight of the substrate, the impregnation being accomplished in one rapid transfer through the present saturator.

Another object of the present invention is to accomplish the impregnation process without the need to heat the saturant solution in many cases, thereby eliminating the need for heating elements and a heating control system, reducing the cost of the saturator and of the impregnation method compared to previous devices, and increasing the cost advantage of the end product relative to competing materials.

A further object of the present invention is to provide a pressure saturator and method which can be used with a variety of different kinds of substrates, and can impregnate a variety of different kinds of saturants into the substrates with dry add on weights ranging from very low percentages to over 75% by weight of saturation.

These and additional objects are attained by the present invention, which relates to a pressure saturator and method for impregnating a porous substrate with a saturant. The preferred embodiment described below has a block member with a sloping upper surface which is graduated from a relatively deep portion to a relatively shallow portion. Conveying means are disposed on both sides of the block member for moving the substrate through the saturator, and a mandrel is disposed between the conveying means, with the lower side thereof extending into the recess formed by the sloping surface and being spaced from the upper surface of the block member for guiding the substrate through the saturator. A chamber is formed by the opposed surfaces of the block member and the mandrel, with a relatively deep entrance region and a relatively shallow exit region, as defined by the sloping surface of the block member. Pressure is developed in the chamber, due to its converging configuration, as the substrate is moved through the saturator, thereby forcing the saturant into the interstices and voids of the substrate. Various substrates may be impregnated with various suitable saturants, depending on the properties desired in the final product. For example, a substrate such as Kraft paper may be impregnated with melamine resin to form an end product suitable for use in constructing counter tops.

Various other objects and advantages of the present invention will become apparent from the following description, with reference to the accompanying drawings.

DETAILED DESCRIPTION OF THE PREFERRED EMBODIMENT

Figure 1:
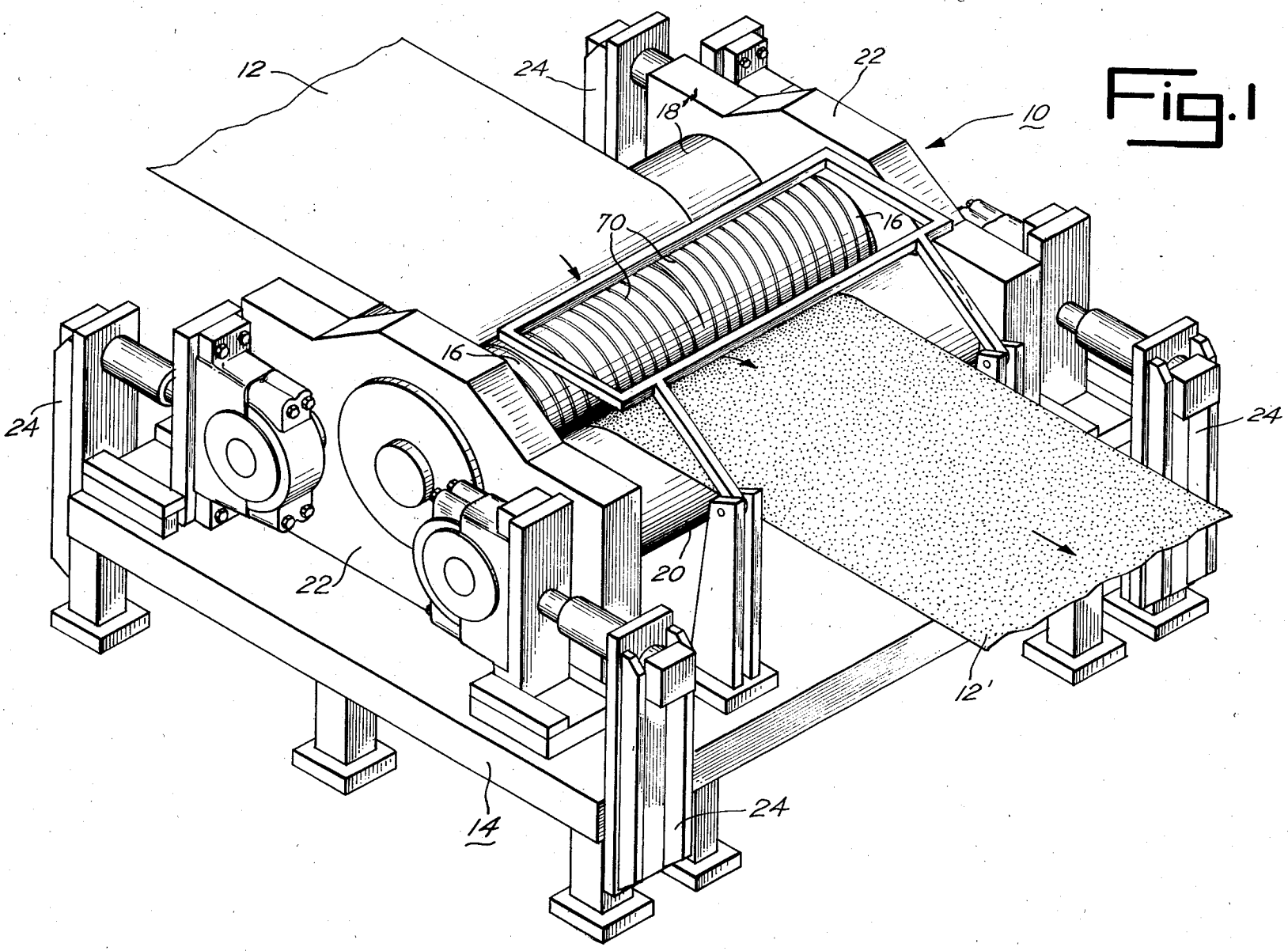
FIG. 1 is a perspective view of the pressure saturator embodying the present invention, shown here in the process of impregnating a substrate.

Referring more specifically to the drawings, and to FIG. 1 in particular, numeral 10 designates generally the presently preferred embodiment of the pressure saturator of the present invention. The saturator may be used with a variety of porous substrates, such as the paper 12, shown here, or with other types of fibrous substrates, such as fiberglass or nylon. Similarly, a wide variety of solids in a saturant solution may be impregnated into the substrate with the present apparatus, sodium silicate and melamine resin serving as two examples. The properties of the end product 12' are a combination of the properties of the substrate and the impregnated solids. For example, the individual cellulose fibers which form the paper 12 are reasonably strong, but are interconnected to form the paper with only weak chemical bonding between the individual fibers, and a slight physical bonding as the paper is made. The treated paper or web, however, has the fibers encapsulated by the solids from the saturant solution, reinforcing the bonding, and protecting the fibers from external forces which could weaken or remove the bonds which hold the substrate together.

The saturator has a base portion 14 which supports the operative elements, including a central mandrel 16. Positioned on each side of the mandrel 16 are conveying means, such as side rollers 18 and 20, the rollers and the mandrel being rotatably mounted at each end thereof. The mandrel 16 is mounted on T-blocks 22, one being located at each end of the mandrel 16. The T-blocks 22 are mounted to respective frame members 23. The T-blocks are shaped such that the central mandrel 16 and the journaled T-blocks 22 can be lifted as a unit from the frame members 23. The side rollers 18, 20 are connected to the frame members 24, which are in turn connected to the frame members 14, disposed at the corners of the base 14 of the saturator, and adjustable both vertically and horizontally for accommodating various substrate thicknesses. The rollers 18, 20 function as conveyors and, in operation, the substrate 12, or web, passes over roller 18, under the mandrel 16, and over roller 20, as indicated by the arrows in FIG. 1. A suitable driving system, such as a chain drive 25, shown in phantom in FIG. 2, for example, is used to drive the rollers and the mandrel during operation. A chain drive system is particularly advantageous, since the chain generally follows the path of the substrate, thus permitting the removal of the mandrel for replacement of the web or mandrel without disassembling the drive system.

Figure 3:
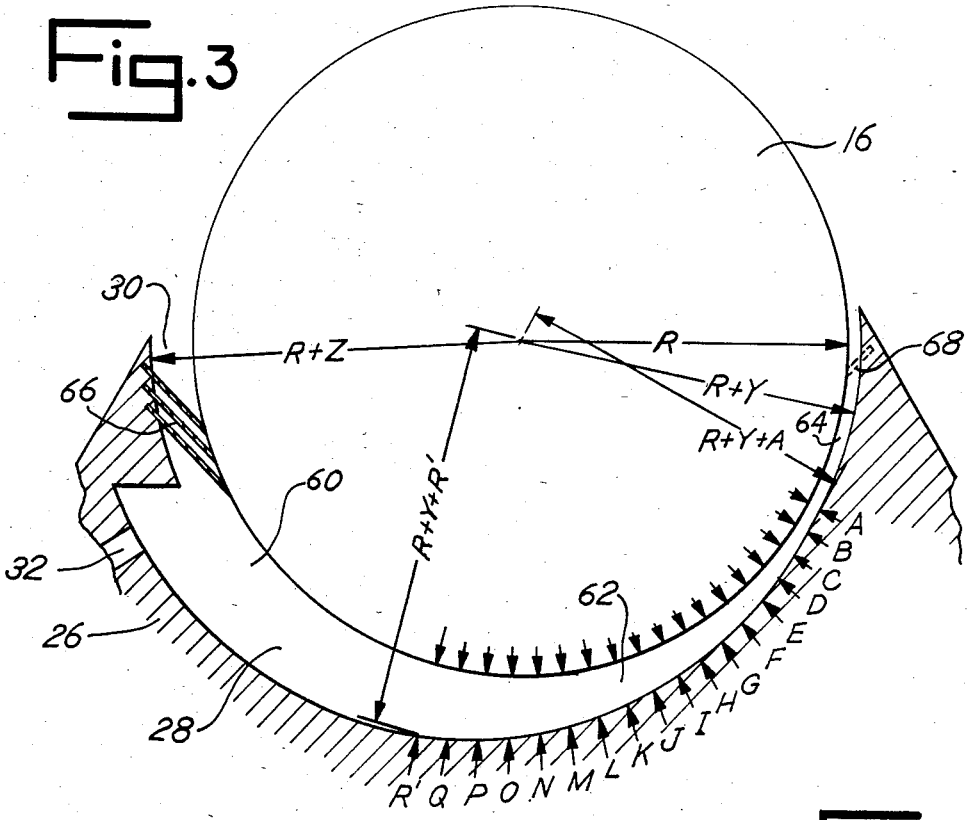
FIG. 3 is an enlarged, fragmentary, side view, shown schematically and partially in cross-section, of the relationship between the central mandrel and the arcuate, sloping upper surface of the saddle block which defines the saturant receiving chamber therebetween.

The mandrel 16 is mounted over a block member, such as saddle block 26, which extends the length of the mandrel 16 and is adjustable both vertically and transversely. The upper surface of the saddle block 26 is sloping and arcuate or concave, with a diameter greater than that of the mandrel 16 to allow the mandrel 16 to be received therein, and is graduated from a relatively deep portion to a relatively shallow portion. A plenum-like cavity or chamber 28 is thus formed between the mandrel 16 and the saddle block 26 for receiving the saturant solution. The saturant solution is contained in an external reservoir (not shown) which does not form part of the present invention. The reservoir may be heated and pressurized, if desired, to control certain variables, such as the viscosity of the solution. The saturant solution may either be carried into the chamber 28 along with the substrate 12 through inlet 30, or it may be pumped in through inlet 32, as shown in FIG. 3. When inlet 30 is used, the saturant solution enters chamber 28 at atmospheric pressure. Inlet 32 is normally closed, but is used under certain conditions, such as when the substrate 12 is relatively thick, when the solution has relatively high viscosity, or when high saturation levels are desired at a low speed of the substrate 12. Under such conditions, additional pressure can be added via a positive displacement pump (not shown) connected through inlet 32 to supply pressurized saturant solution, the pressure supplied being in addition to that developed by the present saturator during operation.

Figure 4:
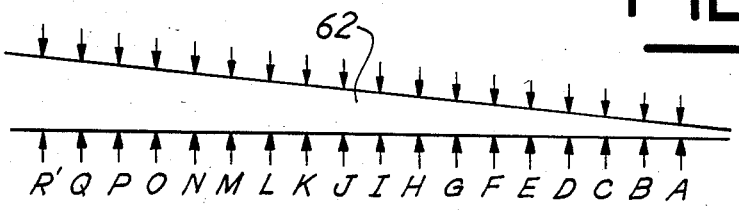
FIG. 4 is a schematic representation of the saturant receiving chamber or plenum of the present invention.

Referring to FIG. 3, the chamber 28 is composed of three regions that are in fluid communication with one another. The first region, designated by numeral 60, is the entry region, which defines a relatively large supply cavity such that proper operation of the present saturator is maintained even if the supply of saturant solution is interrupted for a short period. The second region, designated by numeral 62, is the central region, in which the depth of chamber 28 converges in a linear manner between the point designated as R' and the point designated as A. The decrease in the depth of the chamber preferably occurs at a constant rate per increment of circumference of the mandrel, thereby defining, in effect, an inclined plane, as shown in FIGS. 3 and 4. The third region, designated by numeral 64, is the exit or outlet region, in which the depth or radial width of the chamber is substantially constant and, preferably, substantially equal to the thickness of the substrate 12 or web being processed. This convergent geometry creates dynamic pressures within the chamber when the mandrel 16 is rotated, thereby forcing solids in the saturant solution into the interstices of the particular porous substrate. The pressure is created, maintained, and increased from entry to exit by the movement of the web 12 through the saturator, with respect to the saddle block 26, carrying with it the saturant solution from the relatively deep region 60 to the relatively shallow region 64. The geometry of the chamber 28 may be changed by moving the adjustable saddle block 26 radially or laterally relative to the mandrel 16, using any suitable type of adjustment mechanism, such as shims or screws 65 and 65' schematically shown in FIG. 2, until the desired depth and convergence of the chamber 28 are reached. For example, moving the saddle block 26 toward the mandrel 16 will restrict the entry and exit and lessen the depth of chamber 28, resulting in greatly increased pressure within the chamber 28. Increasing the distance between the mandrel 16 and saddle block 26 has the opposite effect. In addition, while shown as essentially an inclined plane, the chamber 28 may have other converging geometries as well. The dynamic pressure is also created without the provision of heat, thereby lessening the cost of the saturator and the energy costs of using the saturator, and increasing the cost advantage of the end product 12' over competing materials.

Continuing with FIGS. 3 and 4, the mandrel 16 defines a radius R, and the substrate 12 defines a thickness Y. Thus, proceeding from left to right, the depth of the beginning of the central region 62 is defined by R+Y+R'. The depth of the chamber decreases, first to R+Y+Q and so on to R+Y+A. Past the measurement A, the end region 64 has its depth defined by R+Y, which is substantially equal to the radius of the mandrel 16 plus the thickness of the substrate 12 only. This depth in the exit region assures a uniform final distribution of saturant in the processed web 12'. To ensure maintenance of pressure, and to prevent or reduce leakage of saturant, closing means, such as valves 66, are provided in the entry region and may be included at the exit region as well, by valve 68 shown in FIG. 3. The valves may be of any suitable type, such as spring steel, air-loaded, or a hydraulic system, and are biased against the portions of the substrate 12 that pass thereunder, as well as against the mandrel 16 at the sides of the substrate, regardless of the width of the substrate.

Figure 5:
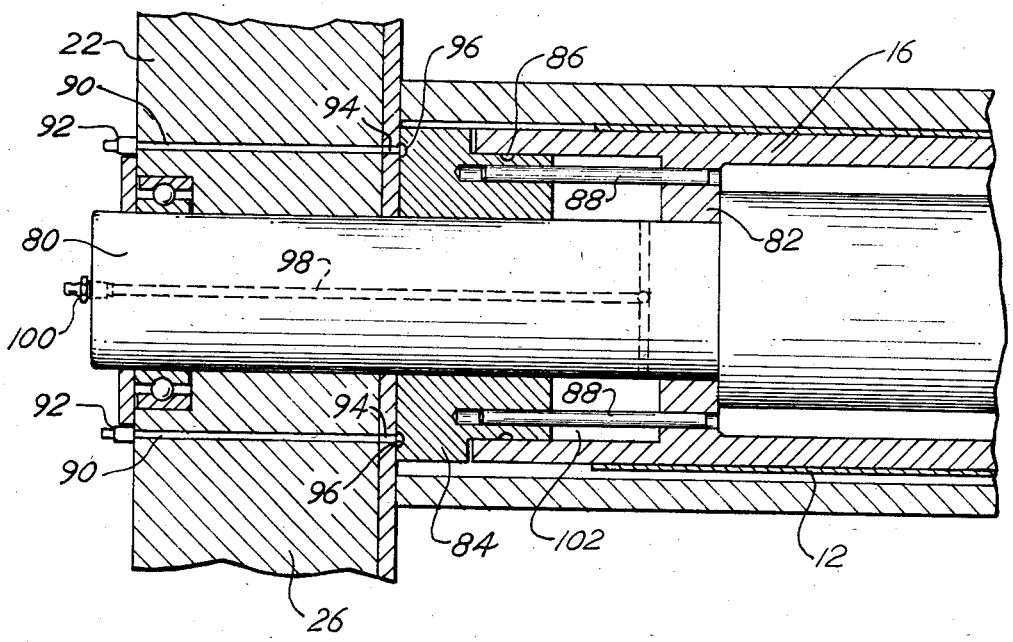
FIG. 5 is a cross-sectional view of one end of the central mandrel, showing the relationship of the end seal to the central mandrel.

FIG. 5 is a longitudinal sectional view through one end of the mandrel 16, and it shows one preferred embodiment of a suitable end seal. As shown in FIG. 5, the mandrel 16 includes a central shaft 80 which is journalled in the T-block 22. An annular diaphragm 82 is rigidly mounted as by welding, for example, between the mandrel 16 and the shaft 80. A flanged bronze seal 84 is positioned between the mandrel 16 and the shaft 80. A flanged bronze seal 84 is positioned between the mandrel 16 and the T-block 22, and is sealed against the mandrel 16 by a seal 86. The seal 84 is mounted to slide on dowels 88 which are secured to the diaphragm 82 such that the seal 84 rotates in unison with the mandrel 16.

The T-block 22 and saddle block 26 define a plurality of oil passages 90, each of which terminates at one end in a fitting 92 and the other end in a shallow recess 94 against the seal 84. The seal 84 defines a circular oil groove 96 adjacent to these recesses 94. An air line 98 passes axially through the shaft 80 and terminates at one end in a fitting 100 and at the other end in a chamber 102 between the seal 84 and the diaphragm 82.

In use, the oil passages 90 are filled with a suitable lubricating oil via the fittings 92, and the chamber 102 is partially filled with hydraulic oil. The fittings 92 and 100 prevent escape of this oil. Compressed air is then introduced via the fitting 100 to bias the seal 84 against the T-block 22 and saddle block 26, thereby creating an end seal which restricts leakage of saturant out of the region between the central mandrel 16 and the T- and saddle blocks 22 and 26.

With the substrate 12 essentially held against the mandrel 16 by the valves 66 and the pressurized solution, groove means, such as grooves 70, may be provided in the outer circumferential surface of the mandrel to permit excess saturant which has passed through the substrate to return to chamber 28. The location and dimensions of the grooves may vary, but, in this embodiment, a symmetrical pattern of grooves is provided, extending spirally outwardly from the center to the ends of the mandrel. The grooves shown are between 0.010 and 0.015 inches in depth and are separated from one another by approximately one-eighth to one-quarter of an inch. The mandrel 16 may also have a smooth outer surface, depending on the particular substrate and the desired end product. After the web 12' has been processed, it passes out of the saturator, over roller 20, and between suitable wiping means, such as doctor blades 72, shown in FIG. 2. The doctor blades remove excess saturant from the web, which then further advances to a suitable drying mechanism (not shown) which does not constitute a part of the present invention.

By way of example only, the following details of construction are provided better to define the preferred embodiment described above. In this embodiment, the central mandrel 16 is 85 inches in length and 21.125 inches in diameter. The shape of the converging surface of the saddle block 26 was machined such that the distance from the center of the mandrel 16 to the surface of the saddle block 26 equals R+Y+N, where R is the radius of the mandrel 16, Y is the thickness of the web, and N is as shown in Table 1. In Table 1, angular positions are measured in degrees counterclockwise from the horizontal passing to the left through the centerline of the mandrel 16 of FIG. 3.

TABLE 1

| Degrees Below Left Horizontal | N (Inches) |
|---|---|
| 10° | 0.250 |
| 20° | 0.234 |
| 30° | 0.219 |
| 40° | 0.203 |
| 50° | 0.188 |
| 60° | 0.172 |
| 70° | 0.156 |
| 80° | 0.141 |
| 90° | 0.125 |
| 100° | 0.096 |
| 110° | 0.068 |
| 120° | 0.039 |
| 130° | 0.010 |
| 140° | 0.000 |
| 150° | 0.000 |
| 160° | 0.000 |
| 170° | 0.000 |

In this embodiment, the surface of the saddle block 26 stopped at 170°. The converging surface of the saddle block 26 was machined from a series of 10° arcs, each having a radius and center chosen to approximate the inclined plane defined in Table 1. This machining technique resulted in a slightly scalloped surface. The valves 66 are oriented at a 45° angle with respect to the central mandrel 16; suitable valves 66 can be constructed from Daetwyler spring steel straight doctor blades 84⅞ inches in length, 2 inches in width, and 0.006 inches in thickness. Using these details of construction, a pressure at point A of 200 psi at a web speed of 150 feet per minute has been calculated, and a pressure of 270 psi at point A at a web speed of 200 feet per minute has been calculated, without supplying additional pressure via the inlet 32.

The present saturator 10 can achieve almost any level of weight-to-weight saturation, from very low concentrations to concentrations over 100% by weight. A substrate which originally contains more air than fibers can be impregnated with the solids in the saturant solution to produce an end product with a higher concentration of the saturant solids than of the fibers themselves. This has great utility, especially in fireproofing, since the possibility of the "tunnel effect", in which flame tunnels through uncoated fibers, can be substantially eliminated. Further advantages in achieving concentrations of 100% or more by weight are found in moisture-proofing a substrate, since substantially all the fibers in the substrate are encapsulated by the saturant material, making them essentially impervious to attack and deterioration from moisture. The process of impregnation is also completed in one rapid transfer through the present apparatus at speeds ranging from ten feet per minute up to hundreds of feet per minute, depending on the nature of the substrate and the saturant solution.

In the use and operation of the present pressure saturator, a substrate 12, or web, is passed over roller 18 and fed into chamber 28 between the mandrel 16 and the saddle block 26. A saturant solution is supplied, normally under pressure, to the chamber 28 through inlet ports 30 or 32. The chamber 28 has a converging geometry from the entrance region to the exit region or outlet, thereby developing dynamic fluid pressure as the web travels with the mandrel through the converging chamber, relative to the saddle block. While various converging geometries may be used, a preferred embodiment is essentially an inclined plane, so as to increase the pressure within the chamber at a constant rate through the central region 62 from entry to exit. The outlet has its depth defined essentially by the thickness of the processed web 12', assuring a complete, final distribution of the saturant in the interstices of the web.

Closing means, such as valves 66 in the entry region and valve 68 in the exit region, may be provided to maintain the pressure developed within the chamber at a suitable level for impregnating the substrate; however, the valves are not necessary for all applications, such as those in which a relatively low concentration of saturant with respect to the substrate is desired, the pressure developed within the chamber being sufficient for the impregnation.

Additional pressure within chamber 28 may be provided by a pump which supplies pressurized fluid, such as a positive displacement pump (not shown) connected to inlet 32, the pressure supplied being additive to that developed within the chamber. The present saturator can produce end products with a weight-to-weight concentration of saturant solids to substrate ranging from a few percent to over one-hundred percent, at which point all the fibers are encapsulated by the solids that remain after the product is dried.

In carrying out the method, the rollers 18 and 20 and the mandrel 16 are driven by a suitable system, such as a chain-drive arrangement. The substrate 12 pushes open the valves 66 enough to allow entrance of the substrate. The valves are biased against the mandrel and, in combination with the pressurized saturant, hold the web against the mandrel. The pressure developed in the central region 62 and the end region 64 of chamber 28 forces the solids in the saturant solution into the interstices and voids of the substrate. As the end product 12' exits the saturator, it pushes valve 69 (if present) closed with clearance and passes under phantom roll 104 and between doctor blades 72 (FIG. 2) which remove excess saturant from the end product, and it is then transferred to a suitable drying apparatus.

By way of example, the apparatus described above has been used as follows to impregnate a web of Kraft paper with sodium silicate. The Kraft paper of this example was 60 inches in width and had an original weight of 42 pounds per thousand square feet. The saturant used was a mixture of water, $Na_2O$ (9.3% of total weight of saturant), and $SiO_2$ (30.0% of total weight of saturant). This saturant had a weight of 11.78 pounds per gallon and a viscosity of 140 Stromer-seconds. The saturating operation was performed at ambient temperature, using a web speed of 120 feet per minute. When no additional pressure was supplied via the inlet 32, the resulting processed paper was found to have a dry weight of 45 pounds per thousand square feet. The represented an add on weight of 8%. When an additional pressure of 10 psi was supplied via the opening 32, the resulting processed paper was found to have a dry weight of 48 pounds per thousand square feet. This represented an add on weight of 15%. As explained above, the add on weight can be varied through a broad range by adjusting either the web speed, the additional pressure, or both. Additional hydraulic pressures as high as 160 psi or higher can be used to achieve extremely high levels of saturation.

While one embodiment of a pressure saturator and several modifications thereof have been shown and described in detail herein, various other changes and modifications may be made without departing from the scope of the present invention.

I claim:

1. A pressure saturator for impregnating a substrate with a saturant, comprising:

a. a block member having a first surface;

b. conveying means for moving the substrate into and out of said saturator;

c. a mandrel rotatably disposed between said conveying means with a selected portion thereof cooperating with the first surface to define a chamber between the first surface and the mandrel sized to receive the substrate; and d. means for supplying a saturant to the chamber;

e. said chamber having a generally converging depth in the direction of travel of the substrate with a relatively deeper entrance region and a relatively shallower exit region for generating a higher pressure in the saturant in the exit region than the entrance region in order to force the saturant into the substrate.

2. A pressure saturator as defined in claim 1 in which said mandrel has a cylindrical outer surface with grooves formed therein for receiving excess saturant which has passed through the substrate and directing the saturant to said chamber.

3. A pressure saturator as defined in claim 1 in which said block member includes valve means extending therefrom and biased to yieldably contact said mandrel for covering said entrance region and maintaining pressure in said chamber.

4. A pressure saturator as defined in claim 3 in which said block member comprises a saddle block, and said first surface has a diameter greater than the diameter of said mandrel.

5. A pressure saturator as defined in claim 1 in which said block member includes valve means extending therefrom and biased to yieldably contact said mandrel for covering said entrance region and exit region and maintaining pressure in said chamber.

6. A pressure saturator as defined in claim 1 in which valve means are yieldably disposed over said entrance region for allowing passage of the substrate into said entrance region and preventing escape of the saturant therefrom.

7. A pressure saturator as defined in claim 6 in which additional valve means are yieldably disposed over said exit region for allowing passage of the substrate out of said chamber and preventing escape of the saturant therefrom, and said exit region is substantially equal in radial width to the thickness of the substrate.

8. A pressure saturator as defined in claim 1 in which said conveying means includes a roller on each side of said mandrel with drive means connecting said rollers to said mandrel for rotation therewith.

9. A pressure saturator as defined in claim 8 in which said chamber has an inlet and an outlet with closing means releasably disposed over said inlet and said outlet for admitting the substrate therethrough and for preventing escape of the saturant from said chamber.

10. A pressure saturator for impregnating a substrate with a liquid saturant, comprising:

a. a block member having a concave upper surface;

b. conveying means rotatably mounted near each side of said block member for moving the substrate through said saturator;

c. a mandrel rotatably mounted between said conveying means and having an outer circumferential surface, the lower portion of which extends into a recess formed by said concave surface and is spaced therefrom;

d. means for supplying a pressurized liquid saturant to said chamber, e. said block member and mandrel cooperating to define a chamber therebetween having an inlet and an outlet and shaped to converge gradually in depth from a relatively deep entrance region near said inlet to a relatively shallow exit region near said outlet such that rotation of the mandrel further pressurizes the liquid saturant and forces the liquid saturant into the substrate.

11. A pressure saturator as defined in claim 10 in which said saturator includes closing means releasably disposed over said chamber inlet for admitting the substrate therethrough and preventing escape of the saturant from said chamber.

12. A pressure saturator as defined in claim 11 in which said saturator includes additional closing means releasably disposed over said chamber outlet for admitting the substrate therethrough and minimizing escape of the saturant from said chamber, and said outlet is adjustable and is normally substantially equal in radial width to the thickness of the substrate.

13. A pressure saturator as defined in claim 12 in which said closing means include valves extending inwardly from said block member to contact said mandrel.

14. A pressure saturator as defined in claim 10 in which said mandrel and block are adjustable relative to one another in the radial direction to vary the size and shape of said chamber and the size of said chamber outlet.

15. A pressure saturator as defined in claim 14 in which said conveying means includes a roller on each side of said mandrel with drive means connecting said rollers to said mandrel for rotation therewith.

16. A pressure saturator as defined in claim 10 in which said conveying means includes a roller on each side of said mandrel with drive means connecting said rollers to said mandrel for rotation therewith.

17. A pressure saturator as defined in claim 16 in which valve means are releasably disposed over said entrance region for allowing passage of the substrate into said entrance region and preventing escape of the saturant therefrom.

18. A pressure saturator as defined in claim 17 in which said block member is a saddle block and said upper surface has a diameter greater than the diameter of said mandrel.

19. A pressure saturator as defined in claim 10 wherein the mandrel is positioned between two end blocks, and wherein the mandrel is provided with two end seals, each operating to seal a respective end of the mandrel against the associated end block.

20. A method of impregnating a substrate with a liquid saturant, using a mandrel and a peripheral saturant chamber of a generally decreasing radial depth from its entrance to its exit such that the saturant chamber converges in depth from a relatively large depth at its entrance to a relatively smaller depth at its exit, the steps comprising:

a. introducing the substrate and the liquid saturant into the chamber;

b. rotating the mandrel in the direction of the decreasing depth of the chamber;

c. moving the substrate along with the periphery of said rotating mandrel through said chamber from the entrance to the exit at a selected rate, said selected rate effective to pressurize the liquid saturant in the chamber, thereby forcing saturant into the substrate to create an inpregnated substrate; and d. withdrawing the impregnated substrate from said chamber through said exit.

21. A method of impregnating a substrate with a liquid saturant as defined in claim 20, in which the liquid saturant is pressurized in a delivery system and is introduced under pressure into the chamber in step (a).

22. A method of impregnating a substrate with a liquid saturant as defined in claim 20, in which said method includes the further step of restricting said entrance and exit to said chamber during step (c) to maintain the pressure developed within said chamber at an elevated level.

23. A method of impregnating a substrate with a liquid saturant as defined in claim 20, in which said method includes the further step of removing excess saturant from the substrate after it emerges from said chamber.

24. A pressure saturator for impregnating a substrate with a liquid saturant, said saturator comprising:

a chamber defining element;

a rotatable mandrel mounted for rotation adjacent to the chamber defining element, said mandrel defining a surface which cooperates with the chamber defining element to form a gradually and progressively converging chamber therebetween, said chamber defining an entrance region and an exit region and shaped to converge in depth from a relatively larger depth in the entrance region to a relatively smaller depth in the exit region;

means for passing the substrate through the chamber from the entrance region to the exit region; and means for supplying liquid saturant to the chamber;

the larger and smaller depths selected such that movement of the saturant through the converging chamber pressurizes the liquid saturant in the chamber, thereby forcing the saturant into the substrate.

25. The pressure saturator of claim 24 wherein the lesser depth is approximately equal to the thickness of the substrate.

26. The pressure saturator of claim 24 wherein the supplying means supplies the liquid saturant to the chamber under pressure.

27. The pressure saturator of claim 24 further comprising means for sealing the chamber to retain pressurized liquid saturant in the chamber.

28. The pressure saturator of claim 24 wherein the converging chamber cooperates with the moving substrate to generate a gradually increasing pressure in the chamber from the entrance region to the exit region.

29. The pressure saturator of claim 24 wherein the supplying means supplies unpressurized liquid saturant to the chamber.

30. A pressure saturator for impregnating a substrate with a liquid saturant, said saturator comprising:

means for defining a converging chamber having an entrance region and an exit region and converging in depth from a relatively larger depth in the entrance region to a relatively smaller depth in the exit region;

means for passing the substrate through the chamber from the entrance region to the exit region; and means for supplying liquid saturant to the chamber;

the larger and smaller depths selected such that movement of the saturant through the converging chamber pressurizes the liquid saturant in the chamber, thereby forcing the saturant into the substrate.

31. The pressure saturator of claim 30 wherein the lesser depth is approximately equal to the thickness of the substrate.

32. The pressure saturator of claim 30 wherein the supplying means supplies the liquid saturant to the chamber under pressure.

33. The pressure saturator of claim 30 further comprising means for sealing the chamber to retain pressurized liquid saturant in the chamber.

34. The pressure saturator of claim 30 wherein the converging chamber cooperates with the moving substrate to generate a gradually increasing pressure in the chamber from the entrance region to the exit region.

35. The pressure saturator of claim 30 wherein the supplying means supplies unpressurized liquid saturant to the chamber.

36. A pressure saturator for impregnating a substrate with a liquid saturant, said saturator comprising:

first and second opposed elements positioned to define a gradually converging chamber therebetween, said converging chamber having an entrance region and an exit region and converging in depth from a relatively larger depth in the entrance to a relatively smaller depth in the exit region;

means for passing the substrate through the chamber from the entrance region to the exit region; and means for supplying liquid saturant to the chamber;

the larger and smaller depths selected such that movement of the substrate through the converging chamber pressurizes the liquid saturant in the chamber, thereby forcing the saturant into the substrate.

37. The pressure saturator of claim 36 wherein the lesser depth is approximately equal to the thickness of the substrate.

38. The pressure saturator of claim 36 wherein the supplying means supplies the liquid saturant to the chamber under pressure.

39. The pressure saturator of claim 36 further comprising means for sealing the chamber to retain pressurized liquid saturant in the chamber.

40. The pressure saturator of claim 36 wherein the converging chamber cooperates with the moving substrate to generate a gradually increasing pressure in the chamber from the entrance region to the exit region.

41. The pressure saturator of claim 36 wherein the supplying means supplies unpressurized saturant to the chamber.

42. A method of impregnating a substrate with a liquid saturant using a converging saturant chamber having an entrance and an exit region and converging in depth from a relatively larger depth in the entrance region to a relatively smaller depth in the exit region, said method comprising the following steps:

supplying liquid saturant to the chamber;

passing the substrate through the chamber from the entrance region to the exit region at a rate such that movement of saturant through the converging chamber pressurizes the liquid saturant in the chamber, thereby forcing the saturant into the substrate to create an impregnated substrate; and withdrawing the impregnated substrate from the exit region of the chamber.

43. The method of claim 42 wherein the lesser depth is approximately equal to the thickness of the substrate.

44. The method of claim 42 wherein pressurized liquid saturant is supplied to the chamber in the supplying step.

45. The method of claim 42 wherein the converging saturant chamber comprises means for sealing the chamber to retain pressurized liquid saturant in the chamber.

46. The method of claim 42 wherein unpressurized liquid saturant is supplied to the chamber in the supplying step.

47. The method of claim 42 wherein the converging chamber is defined between a rotatable mandrel and an adjacent block member.

48. The method of claim 42 wherein the chamber converges gradually and progressively from the entrance region to the exit region.

* * * * *

UNITED STATES PATENT AND TRADEMARK OFFICE

CERTIFICATE OF CORRECTION

PATENT NO. : 4,588,616

DATED : May 13, 1986

INVENTOR(S) : Howard K. Menser

It is certified that error appears in the above-identified patent and that said Letters Patent is hereby corrected as shown below:

The Title Page should be deleted to appear as per attached Title Page.

United States Patent [19]

Menser

[11] Patent Number: 4,588,616

[45] Date of Patent: May 13, 1986

[54] METHOD AND APPARATUS FOR PRESSURE SATURATION OF SUBSTRATE

[75] Inventor: Howard K. Menser, Plymouth, Ind.

[73] Assignee: Miply Equipment Inc., South Bend, Ind.

[21] Appl. No.: 661,913

[22] Filed: Oct. 17, 1984

Related U.S. Application Data

[63] Continuation-in-part of Ser. No. 641,568, Aug. 16, 1984, abandoned.

[51] Int. Cl.[4] ..... B05D 1/18; B05C 3/12

[52] U.S. Cl. ..... 427/430.1; 118/117; 118/419; 118/429; 427/439

[58] Field of Search ..... 68/15, 158; 118/117, 118/419, 429; 156/189; 427/365, 439, 430.1

[56] References Cited

U.S. PATENT DOCUMENTS

| | | | |
|---|---|---|---|
| 2,176,835 | 10/1939 | Cumfer . | |
| 2,711,032 | 6/1952 | Penley | 34/122 |
| 2,721,144 | 10/1955 | Penley | 118/419 X |
| 3,416,939 | 12/1968 | Schutt et al. | 106/84 |
| 3,449,156 | 6/1969 | Brown . | |
| 3,454,419 | 7/1969 | Smith et al. | 117/76 |
| 3,564,631 | 2/1971 | Burling . | |
| 3,616,194 | 10/1971 | Russell | 156/189 X |
| 3,616,660 | 11/1971 | Ingermarsson . | |
| 3,826,703 | 7/1974 | Russell | 156/189 |
| 4,152,908 | 5/1979 | Bertoldi | 68/158 |
| 4,411,216 | 10/1983 | Menser | 118/117 |

*Primary Examiner*—Michael R. Lusignan

*Attorney, Agent, or Firm*—Willian Brinks Olds Hofer Gilson & Lione

[57] ABSTRACT

A pressure saturator for impregnating a substrate with a saturant is disclosed, having a block member with an arcuate, sloping upper surface that is graduated from a relatively deep portion to a relatively shallow portion. Rollers are disposed on each side of the block member for conveying the substrate into and out of the saturator, and a mandrel is disposed between the rollers for guiding the substrate through the saturator. The lower portion of the mandrel is spaced from the block member and extends into the recess formed by the arcuate surface to define a chamber therebetween. The chamber has an inlet and an outlet for admitting the substrate and the saturant, and converges in depth from the inlet region to the outlet region to pressurize the solution and force the saturant into the interstices of the substrate.

48 Claims, 5 Drawing Figures

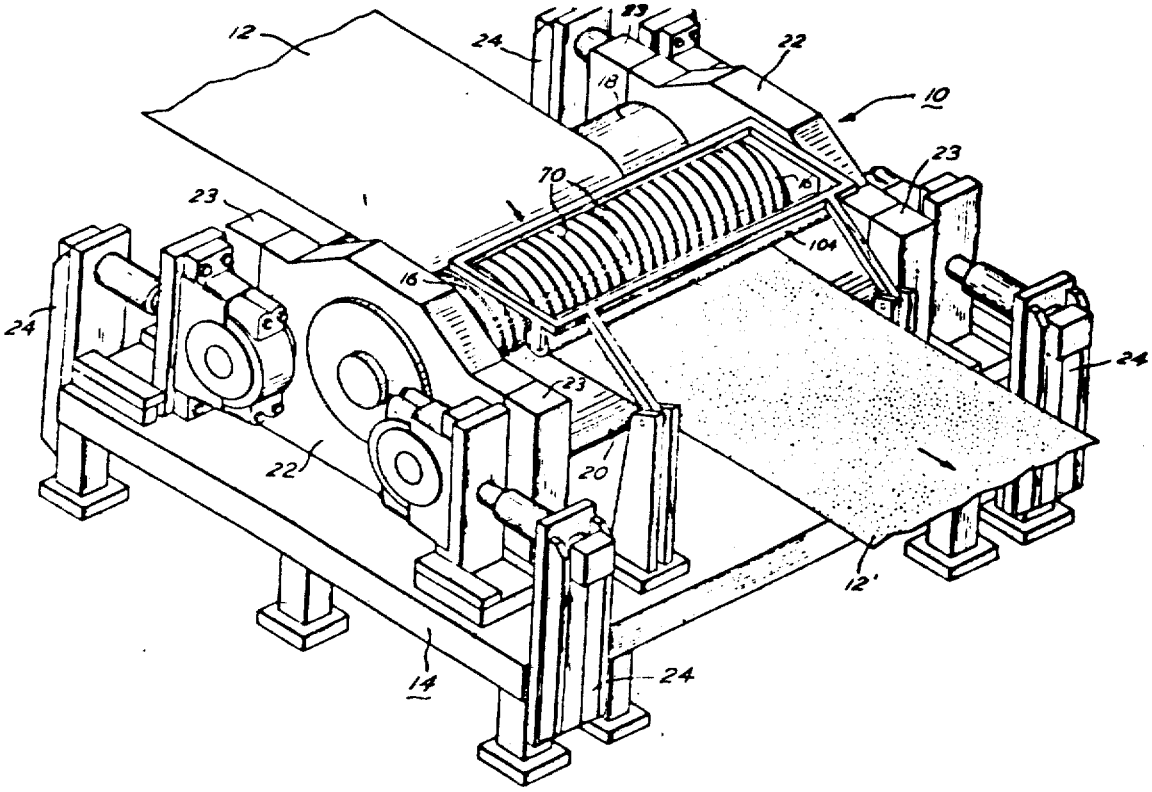

UNITED STATES PATENT AND TRADEMARK OFFICE

CERTIFICATE OF CORRECTION

PATENT NO. : 4,588,616

DATED : May 13, 1986

INVENTOR(S) : HOWARD K. MENSER

It is certified that error appears in the above-identified patent and that said Letters Patent is hereby corrected as shown below:

IN THE DRAWINGS

Figure 2:
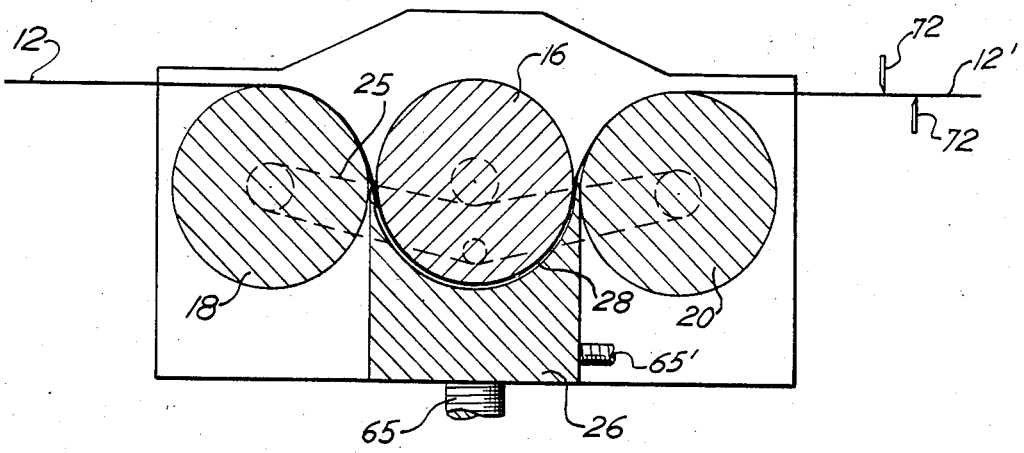
FIG. 2 is a schematic representation, shown partially in cross-section, of the relationship between the central mandrel and support and adjustment structures and the side rollers.

Please substitute the following Figures 1, 2 and 5 as originally filed. Please correct Figure 5 to show reference numerals 22 and 26.

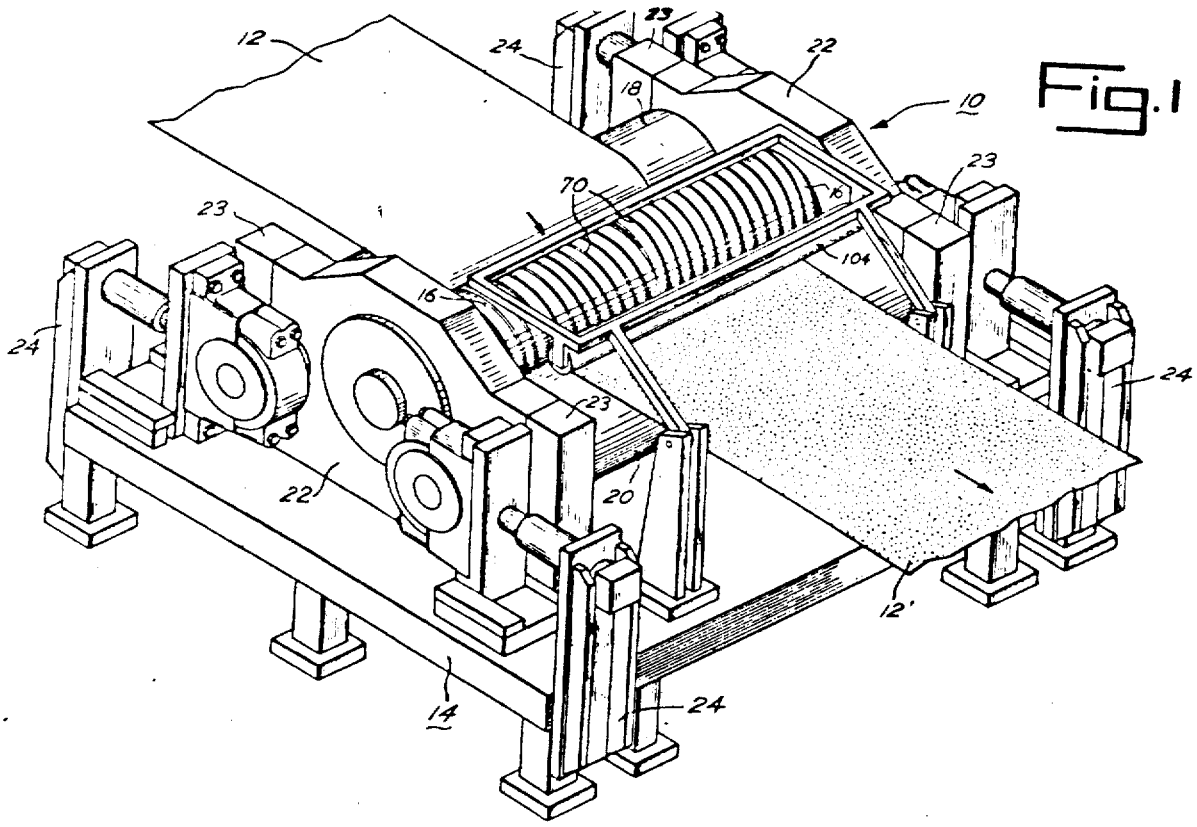

UNITED STATES PATENT AND TRADEMARK OFFICE

CERTIFICATE OF CORRECTION

PATENT NO. : 4,588,616

DATED : May 13, 1986

INVENTOR(S) : HOWARD K. MENSER

It is certified that error appears in the above-identified patent and that said Letters Patent is hereby corrected as shown below:

Fig. 2

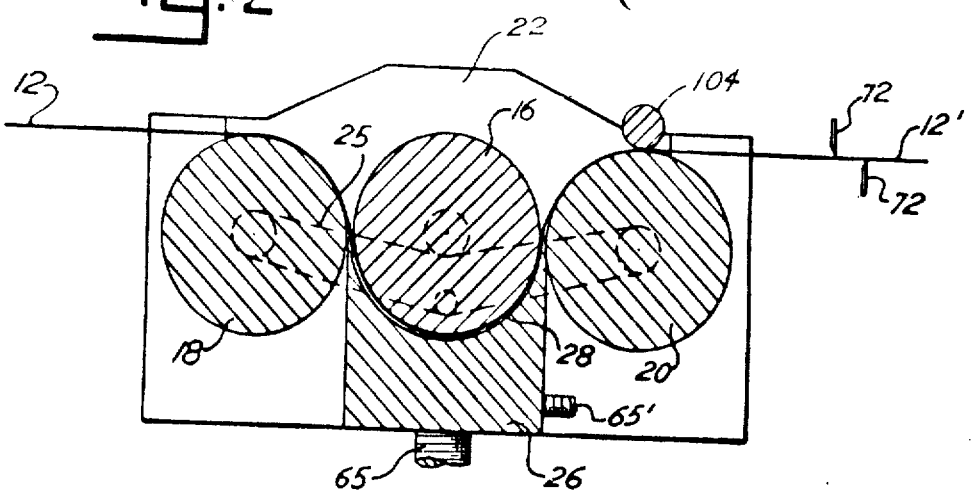

UNITED STATES PATENT AND TRADEMARK OFFICE

CERTIFICATE OF CORRECTION

PATENT NO. : 4,588,616

DATED : May 13, 1986

INVENTOR(S) : HOWARD K. MENSER

It is certified that error appears in the above-identified patent and that said Letters Patent is hereby corrected as shown below:

Fig. 5

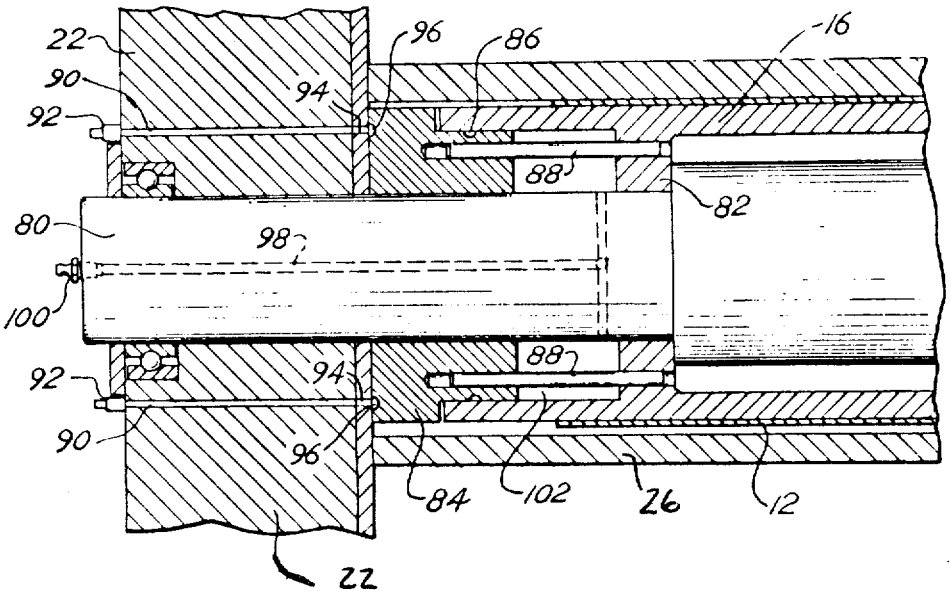

UNITED STATES PATENT AND TRADEMARK OFFICE

CERTIFICATE OF CORRECTION

PATENT NO. : 4,588,616

DATED : May 13, 1966

INVENTOR(S) : HOWARD K. MENSER

It is certified that error appears in the above-identified patent and that said Letters Patent is hereby corrected as shown below:

IN THE DETAILED DESCRIPTION OF THE PREFERRED EMBODIMENT

In Column 3, line 37, please delete "24" and substitute therefor --23--;

In Column 3, line 38, please delete "14" and substitute therefor --24--;

In Column 7, line 44, please delete "69" and substitute therefor --68--;

In Column 7, line 63, please delete "The" and substitute therefor --This--;

In Column 7, line 63, please delete "8%" and substitute therefor --7%--;

In Column 7, line 67, please delete "15%" and substitute therefor --14%--.

IN THE CLAIMS

In Claim 20 (Col. 10, line 1), please delete "large" and substitute therefor --larger--;

In Claim 20 (Col. 10, line 13), please delete "inpregnated" and substitute therefor --impregnated--.

Signed and Sealed this

*Sixteenth* Day of *September 1986*

[SEAL]

*Attest:*

DONALD J. QUIGG

*Attesting Officer*

*Commissioner of Patents and Trademarks*